US005606863A

United States Patent [19]

Kicklighter et al.

[11] Patent Number: 5,606,863

[45] Date of Patent: Mar. 4, 1997

[54] GLASS FRONT, ANTI-CONDENSATION REFRIGERATED DISPLAY

[75] Inventors: Berry C. Kicklighter, Conyers; Sohail Najmi, Norcross, both of Ga.

[73] Assignee: Kysor Industrial Corporation, Cadillac, Mich.

[21] Appl. No.: 503,305

[22] Filed: Jul. 17, 1995

[51] Int. Cl.[6] ..... A47F 3/04

[52] U.S. Cl. ..... 62/89; 62/248

[58] Field of Search ..... 62/248, 89; 454/123

[56] References Cited

U.S. PATENT DOCUMENTS

| | | | |
|---|---|---|---|
| 1,610,244 | 12/1926 | Bonaccolta | 62/248 |
| 1,940,515 | 12/1933 | Sundling et al. | 62/248 X |
| 2,672,735 | 3/1954 | Fusselman | 62/248 |
| 3,025,681 | 3/1962 | Booth | 62/248 |
| 3,125,864 | 3/1964 | Ural | 62/248 |
| 3,307,373 | 3/1967 | Booth | 62/248 |
| 3,462,966 | 8/1969 | Reid et al. | 62/248 |
| 4,325,227 | 4/1982 | Ibrahim | 62/248 |
| 4,750,335 | 6/1988 | Wallace | 62/248 |
| 4,782,666 | 11/1988 | Costan | 62/248 |

*Primary Examiner*—William E. Tapolcai

*Attorney, Agent, or Firm*—Price, Heneveld, Cooper, DeWitt and Litton

[57] ABSTRACT

A refrigerated display case comprising a housing having a front display window, a top, a rear wall, and a base, all defining an enclosed space for display of food products, the base having a chamber containing a refrigeration coil and air propelling fans for propelling cooled air, an air inlet duct from the enclosed space to the chamber and an outlet duct from the chamber to the enclosed space oriented upwardly inside the chamber for propelling circulated air up to the top and down across the front display window inner surface to the air inlet duct for recirculation, the top having a contour outlet from the space to the exterior of the housing, oriented toward the front display window for flow of a portion of circulated cool air down across the front display window outer surface to cool it and evaporate moisture to prevent sweating.

14 Claims, 1 Drawing Sheet

GLASS FRONT, ANTI-CONDENSATION REFRIGERATED DISPLAY

BACKGROUND OF THE INVENTION

This invention relates to refrigerated display cases, and closed display cases as of the deli service type.

Closed refrigerated display cases, because of the cool air inside the case, tend to collect condensed moisture on the glass window used to display the food products, i.e., the windows tend to "sweat." Condensation moisture on the inner surface can be prevented by circulating refrigerated air within the case, the moisture being picked up and condensed on the refrigeration coil used to cool the air. As to the exterior surface of the display window, the typical technique for preventing/removing condensation is to warm the window with added heat. This can be heat applied directly to the window, or heat applied to a portion of the flowing air in the cabinet, causing the heated air portion to flow across the window inner surface to warm the window. An example of the use of a heater placed in the air stream for this purpose is shown in U.S. Pat. No. 4,750,335. While application of heat is effective, it requires use of extra energy to create the heat, and then more energy for extra cooling action to again cool the heated air for preventing unwanted temperature rise within the cabinet display area and the stored food.

SUMMARY OF THE INVENTION

An object of this invention is to provide a refrigerated display case with an anti-sweat feature without using added heat. The novel case uses features causing special air flow travel to forestall condensation, i.e., sweat, on the exterior surface as well as the interior surface of the display case window. The case has a refrigeration air flow recirculation system that propels air up from the base of the cabinet across the inside surface of one wall of the case, preferably the rear wall, to the top of the case, across the inside of the top of the case and down the inside surface of the other wall, preferably the front window, and back to the fans and refrigeration coil in the base. The top has a special contoured outlet that causes a portion of the recirculated cooled air to flow out of the case at the top, the contoured outlet being oriented to cause this air portion to flow down across the exterior surface of the front window.

These and other objects, advantages and features of the invention will become apparent upon studying the following specification in conjunction with the drawings.

DETAILED DESCRIPTION OF THE PREFERRED EMBODIMENT

Figure 1:
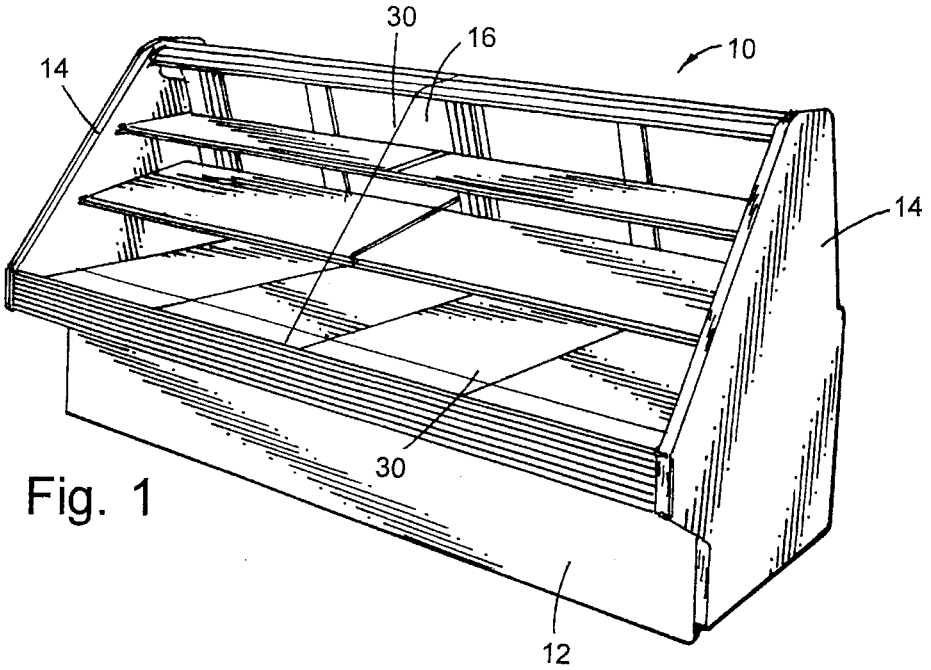
FIG. 1 is a perspective view of a display case employing this invention.

Referring now specifically to the drawings, the display case 10 there depicted is shown to be of the deli style. It has a base 12, a pair of closed ends 14, a front including a transparent display window 16, shown to be diagonally oriented, i.e., at an obtuse angle to the top, a rear wall 18 shown to contain slidable window-type service doors, and a top 20 between the front 16 and rear 18, all defining a food storage and display space 36. Top 20 preferably joins front 16 in a smooth, convexly curved junction surface 21. Doors 18 allow store personnel to insert food items onto the storage shelves 22 and 24 placed at various vertically spaced heights within the cabinet. Base 12 may include suitable support legs 13 in conventional fashion. A chamber 26 is defined within the base beneath the bottom support surface or shelf 28. This chamber 26 has a first air flow duct 30 along the lower edge of front wall 16, connecting space 36 and chamber 26.

Within chamber 26 are a plurality of air propulsion motor driven fans 32 along its length, and a refrigeration coil 34 along the length of the case, and which may comprise one or more coil units. Coil 34 is of the conventional evaporator type typically used in refrigerated display cases, conducting refrigerant through its tubing after the refrigerant is compressed, then cooled in a condenser, and then evaporated in the system to lower its temperature by loss of heat of vaporization. This is done by conventional apparatus (not shown). This fluid cools the external circulating air passing through the coil. Air within chamber 26 is propelled by recirculation fans 32 through refrigeration coil 34.

Figure 3:
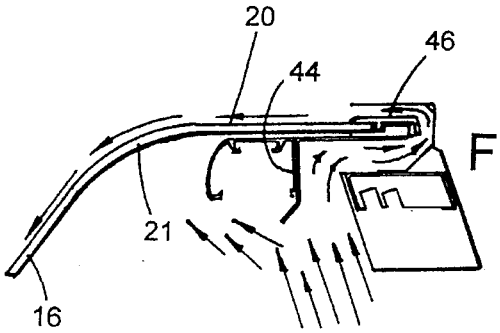
FIG. 3 is a fragmentary, enlarged, cross-sectional view of the top portion of the display case in FIGS. 1 and 2.
Figure 2:
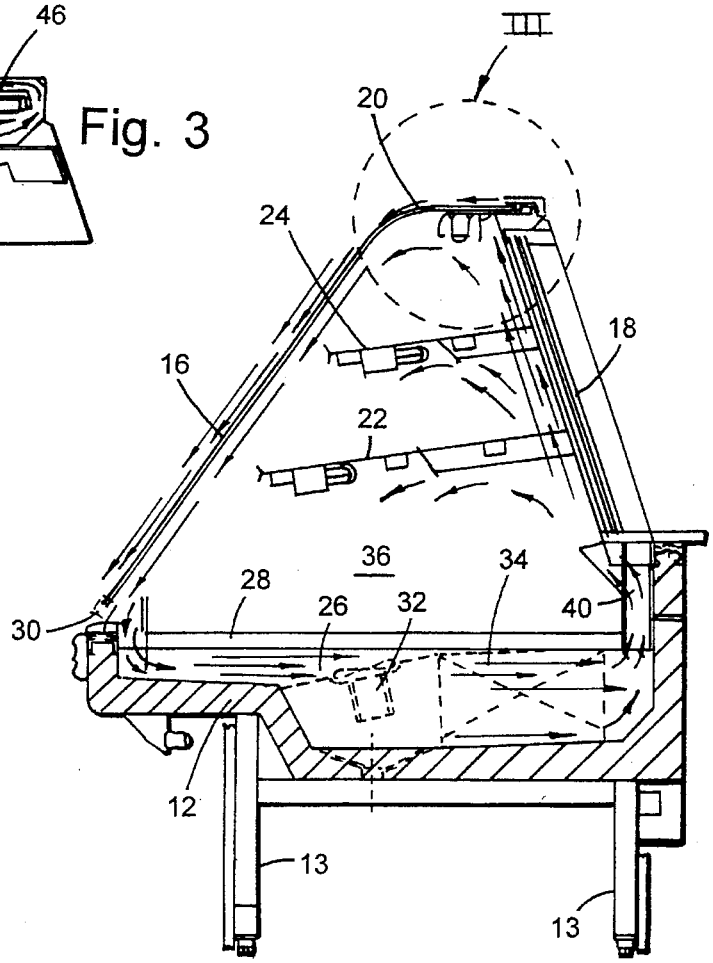
FIG. 2 is a cross-sectional view of the display case in FIG. 1.

A second air flow duct 40 also connects space 36 and chamber 26, offset from first duct 30. Preferably duct 30 is the inlet to chamber 26 from space 36, and duct 40 is the outlet from chamber 26 to space 36. Outlet 40 from chamber 26 extends along the base of rear wall 18 thereof and has its outlet oriented upwardly into space 36 to cause cooled air to flow up across the inside surface of rear wall 18, i.e., the service doors, to the top 20 of the case where a substantial share of the air, but not all, follows along the inside surface of top 20 and is then deflected downwardly across the inside surface of front display window 16, finally entering inlet 30 along the length of the base of window 16, through space between the outer ends of shelves 24 and 22 and window 16, to again be recirculated by fans 32 through coil 34 as previously noted. A small amount of the upflowing air on the way to top 20 is preferably diverted below each of shelves 22 and 24 to help keep the shelves and food product cool, and then rejoins the downflowing air adjacent the inside surface of window 16. Within top 20 of case 10 is an elongated air scoop 44 which has an inlet oriented toward the upflowing air, i.e., downwardly in this illustrated embodiment, toward space 26 and adjacent the upper edge of the inner surface of rear wall 18, to receive a portion of the upflowing refrigerated air as depicted by the arrows in FIG. 3, and direct this portion of air through an elongated top outlet 46, to cause the air portion to flow out of the case. This outlet 46 is oriented to cause the air to flow down across the outer surface of the front display window. In the illustrated embodiment it first flows across the outer surface of top 20, and since cooled air flowing across a surface tends to cling to the surface when the surface changes direction, the air will flow around the curved bend 21 joining top 20 and front display window 16, and down across the diagonal front as depicted by the arrows in FIG. 3. This cooled air flowing across the exterior surface of window 16 will tend to be drier so as to not only cool the outer surface of window 16 and thereby control the temperature of the glass, but also to absorb moisture therefrom to prevent the glass from sweating. This exterior portion of propelled air can then be allowed to flow through small openings back into inlets 30 between the sections of front window 16 and even along the lower edge thereof, to be recirculated, and/or may be at least partially discharged into the aisle.

Conceivably the recirculating air inside the cabinet could flow in the opposite direction of that shown by the arrows, such that the cooled air would discharge from orifice 30, flow upwardly across the inside of window 16, across the top 20 and back down the inside surface of the back 18 to orifice 40 and thence through the coil and fans. In this event, the scoop at the top of the cabinet could be oriented a little differently to receive a portion of the air flowing upwardly along window 16 and/or along the inside surface of top 20, and cause this portion of air to exit and be reversed to flow down across the exterior surface of window 16 in the manner and for the purpose previously described.

Also, fans 32 could be placed upstream or downstream of coil 34 in either embodiment.

It is conceivable that certain other variations could be made to the preferred embodiment set forth, within the concept taught herein. Thus, the invention is not intended to be limited to the specific preferred embodiment depicted as illustrative, but only by the scope of the appended claims and the structures which are equivalent thereto.

The embodiments of the invention in which an exclusive property or privilege is claimed are defined as follows:

1. A refrigerated display case comprising:

a housing having a front display window with an inner surface and an outer surface, said housing having a top, a rear wall having an inner surface, and a base, all defining an enclosed space for display of food products;

said base having a chamber containing a refrigeration coil and air propelling fans for propelling cooled air, an air inlet duct from said enclosed space to said chamber adjacent said front display window, and an outlet duct from said chamber to said enclosed space oriented upwardly inside said chamber at said rear wall for propelling circulated air up said rear wall inner surface to said top, and down across said front display window inner surface to said air inlet duct for recirculation;

said top having a contour outlet from said space to the exterior of said top, out of said case, said contour outlet being oriented toward said front display window for flow of a portion of circulated cool air out of said case and down across said front display window outer surface to cool said front display window outer surface for anti-condensation thereof.

2. The refrigerated display case in claim 1 wherein said contour outlet is oriented across said top to cause said air portion to flow across said top and then down across said front display window.

3. The refrigerated display case in claim 2 wherein said front display window is diagonally oriented to be at an obtuse angle relative to said top.

4. The refrigerated display case in claim 3 wherein said top and said front display window are joined by a convexly curved junction.

5. The refrigerated display case in claim 1 wherein said rear wall comprises service doors.

6. The refrigerated display case in claim 3 wherein said service doors have windows.

7. The refrigerated display case in claim 1 wherein said top includes an air inlet scoop leading to said contour outlet, oriented to receive said portion of air.

8. A refrigerated display case comprising:

a housing having a front display window with an inner surface and an outer surface, said housing having a top, a rear wall, and a base, all defining an enclosed space for display of food products;

said base having a chamber containing a refrigeration coil and air propelling fans for propelling cooled air, an air inlet duct from said enclosed space to said chamber for flow of circulated air from said space to said chamber, and an outlet duct from said chamber to said enclosed space, oriented upwardly inside said chamber for propelling circulated air up to said top and adjacent said shelves, from said chamber to said space, and down again to said air inlet duct for cooling and recirculation;

said top having a contour outlet at said top from said space to the exterior of said housing, out of said case, said contour outlet being oriented toward said front display window for flow of a portion of circulated cool air down across said front display window outer surface to cool said front display window outer surface and evaporate moisture therefrom for anti-condensation purposes.

9. The refrigerated display case in claim 8 wherein said inlet and outlet ducts are located adjacent said rear wall and front wall to cause air flow within said housing across said front display window inner surface adjacent said shelves.

10. The refrigerated display case in claim 8 wherein said contour outlet is oriented across said top to flow across said top and then down across said front display window.

11. The refrigerated display case in claim 10 wherein said front display window is diagonally oriented to be at an obtuse angle relative to said top.

12. The refrigerated display case in claim 11 wherein said top and said front display window are joined by a convexly curved junction.

13. A method of preventing condensation on the exterior surface of a front display window of a closed refrigerated display case having a top, a base containing an air cooling coil and air circulating fans, inlet and outlet ducts to and from said air cooling coil, ends, a rear wall and said front display window, comprising the steps of deflecting a portion of the circulating air in said case out of said case at said top and causing it to flow down across the exterior surface of said front display window to thereby prevent condensation on said exterior surface.

14. The method in claim 13 wherein said air portion is deflected out across said top of said case toward said front display window to then flow down across said front display window exterior surface.

* * * * *